US009387702B2

(12) United States Patent
Poma et al.

(10) Patent No.: US 9,387,702 B2
(45) Date of Patent: Jul. 12, 2016

(54) PRINTER WITH IMPROVED PAPER BOARD

(71) Applicant: Shenzhen Pu Ying Innovation Technology Corporation Limited, Shenzhen (CN)

(72) Inventors: Paolo Poma, Ivrea (IT); Davide Nico, Ivrea (IT)

(73) Assignee: Shenzhen Pu Ying Innovation Technology Corporation Limited, Shenzhen (CN)

( * ) Notice: Subject to any disclaimer, the term of this patent is extended or adjusted under 35 U.S.C. 154(b) by 0 days.

(21) Appl. No.: 14/655,255

(22) PCT Filed: Dec. 28, 2012

(86) PCT No.: PCT/EP2012/077049

§ 371 (c)(1),
(2) Date: Jun. 24, 2015

(87) PCT Pub. No.: WO2014/101950

PCT Pub. Date: Jul. 3, 2014

(65) Prior Publication Data

US 2015/0352863 A1 Dec. 10, 2015

(51) Int. Cl.

| | |
|---|---|
| ***B41J 11/00*** | (2006.01) |
| ***B41J 13/10*** | (2006.01) |
| ***B65H 1/04*** | (2006.01) |

(52) U.S. Cl.

CPC ..... *B41J 11/0045* (2013.01); *B41J 13/103* (2013.01); *B65H 1/04* (2013.01); *B65H 2402/31* (2013.01); *B65H 2402/46* (2013.01); *B65H 2405/1117* (2013.01); *B65H 2405/11172* (2013.01); *B65H 2405/111646* (2013.01); *B65H 2405/324* (2013.01); *B65H 2801/06* (2013.01)

(58) Field of Classification Search
None
See application file for complete search history.

(56) References Cited

U.S. PATENT DOCUMENTS

| | | | | |
|---|---|---|---|---|
| 6,428,000 | B1 * | 8/2002 | Hara | B65H 31/20 271/207 |
| 2002/0060401 | A1 | 5/2002 | Matsukawa | |
| 2003/0047609 | A1 * | 3/2003 | Endo | H04N 1/00588 235/454 |
| 2006/0001209 | A1 | 1/2006 | Takagi | |
| 2006/0181577 | A1 * | 8/2006 | Endo | B41J 2/06 347/55 |
| 2010/0323286 | A1 * | 12/2010 | Iguchi | B41J 2/32 430/19 |

FOREIGN PATENT DOCUMENTS

| | | | | |
|---|---|---|---|---|
| EP | 1595708 | A1 | 11/2005 | |
| JP | H11100158 | A | 4/1999 | |
| JP | EP 1595708 | A1 * | 11/2005 | B41J 13/103 |
| JP | 2007161369 | A * | 6/2007 | |
| JP | 2011236022 | A | 11/2011 | |

OTHER PUBLICATIONS

International Search Report of PCT/EP2012/077049 mail Sep. 5, 2013.

* cited by examiner

*Primary Examiner* — Bradley Thies
(74) *Attorney, Agent, or Firm* — PROI Intellectual Property US

(57) ABSTRACT

It is disclosed a printer comprising an opening through which one or more sheets to be treated could be introduced therein and further comprising a paper board for supporting said one or more sheets to be treated, wherein said paper board comprises at least one root and at least a free end, wherein said at least one free end is movable with respect to said at least one root when it is subject to a vertical load.

13 Claims, 8 Drawing Sheets

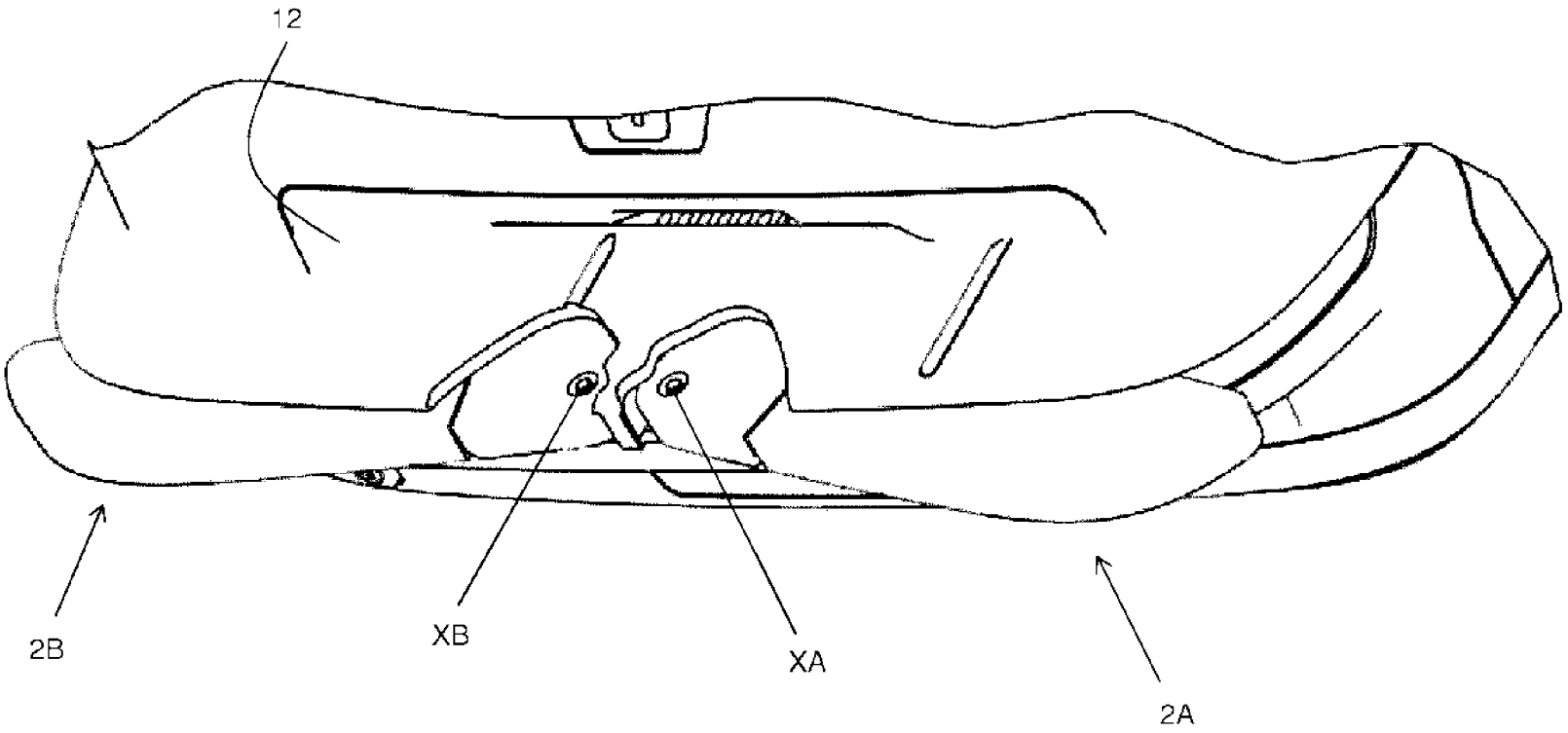
Fig. 4.1

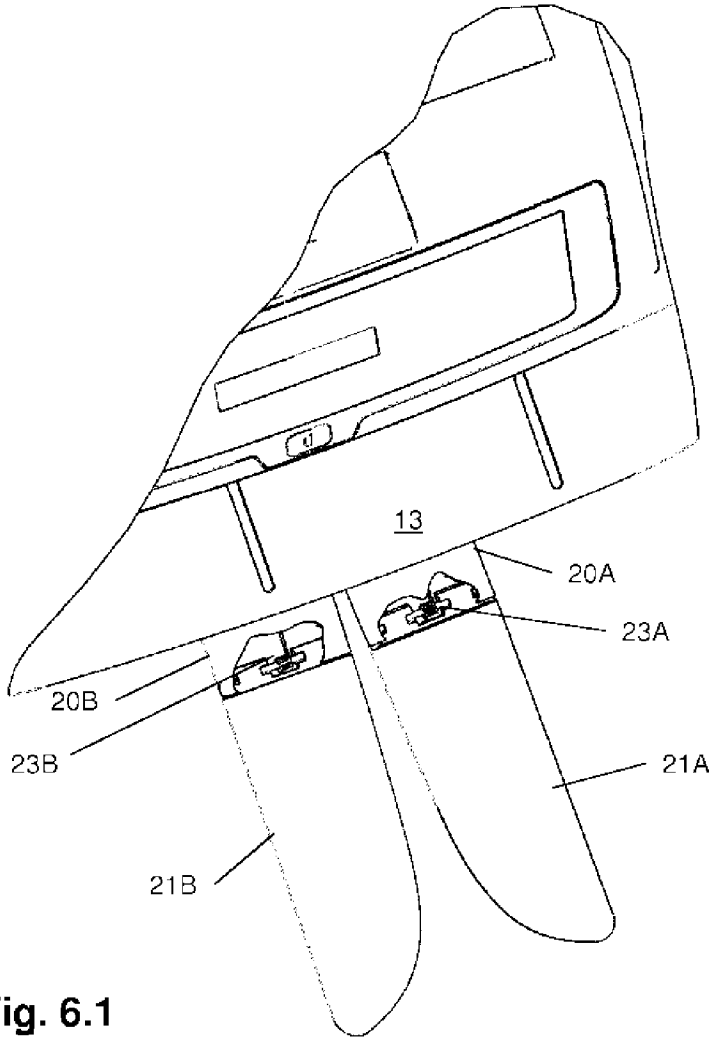
Fig. 6.1

PRINTER WITH IMPROVED PAPER BOARD

The present invention relates to a printer or the like having an improved paper board which is configured for resisting to shocks and/or loads.

In the present description and claims the term "printer" should be intended as including any peripheral device to be connected (by any means, such as through a cable, a wireless link, an infrared link or the like) to a computer, a personal computer, a smart phone or the like and configured for managing sheets. Examples of "printer" are: a printer for printing one single sheet of paper or a plurality of sheets of paper connected together; a printer for printing a sheet of material other than paper; a scanner, a facsimile machine or any multifunction machine which comprises one or more of the above functionalities.

In the art, several different designs of printers are known. The difference being at least in the printing technology (laser printing, ink-jet printing, dot-matrix printing, . . . ) and/or in the main intended use (domestic use, small office use, large companies use, . . . ). Printers which are designed for private use or use by a rather reduced number of people as in a small office are generally rather compact in size because they are intended to be supported on a desk or table in proximity of the computer of the user.

Typically, a printer comprises a paper board for supporting the sheet(s) to be printed and/or the sheet(s) which has/have been printed. Typically, a printer which is intended to be used by a single user or by a limited number of users, just because it needs to be as compact as possible, comprises a movable or removable paper board.

Such a movable or removable paper board can be arranged in a working position where it indeed supports the sheet(s) during the printer operation and projects outwardly from the shape of the printer at the opening which receives the sheets to be printed or outputs the printed sheets.

The movable or removable paper board can be also arranged in a rest position corresponding to a non working position of the printer. In the rest position, typically, the paper board becomes retracted or inset and it does not substantially project outwardly from the shape of the printer. The rest position of the paper board is provided in order to save space in the area where the printer is installed when the printer is not in use. In addition, when the paper board is in the rest position, it is more protected and prevented from becoming damaged.

US2006/0001209 A1 relates to a printer having a paper sheet output tray configured so as to be freely pulled out from or put in the paper sheet outlet.

SUMMARY OF THE INVENTION

The Applicant has noticed that when the paper board of a known printer is extracted and projects outwardly it may be subjected to shocks, mainly to unintentional pressures and vertical loads. Such pressures, typically loads directed downwardly, may damage the paper board and render it no more usable. In some cases, the paper board may become broken and it should be replaced by a new paper board.

The replacement of a part of a printer is expensive and may cause stops of normal working. Sometimes it may result in the need to replace the whole printer in view of possible difficulties in obtaining special parts after some times from installation of the printer.

In view of the above, the Applicant has tackled the problem of providing a printer with a paper board which overcomes the aforesaid drawback.

In particular, the Applicant has tackled the problem of providing a printer with a paper board which is more robust and which may resist to certain types of shocks and loads, typically substantially unintentional vertical loads.

The Applicant has observed that a paper board of a printer may be rendered more resistant to shocks and loads by providing such a paper board with at least one free end part which is movable with respect to a root part when it is subject to such shocks and loads; profitably, in absence of shocks and loads, the at least one free end part cooperates with the root part for providing a substantially continuous support surface.

According to a first aspect, the present invention relates to a printer comprising an opening through which one or more sheets to be treated could be introduced therein and further comprising a paper board for supporting said one or more sheets to be treated, wherein said paper board comprises at least one root and at least a free end, wherein said at least one free end is movable with respect to said at least one root when it is subject to a vertical load.

Preferably, said at least one free end is rotatable about an axis with respect to said at least one root.

In preferred embodiments, the at least one root and the at least one free end are connected through a resilient means. The resilient means may comprise a spring or a rubber element.

In embodiments of the invention, the paper board comprises two half paper boards. Preferably, the two half paper boards are rotatable from a fully retracted configuration to a fully extended configuration.

In embodiments of the invention, the two half paper boards are jointly rotatable so that rotation of one half paper board results in corresponding rotation of the other paper board.

The printer may further comprising a magnetic device for attracting at least one of said two half paper boards towards a body of the printer. The magnetic device may comprise a magnet and a ferromagnetic element.

Preferably, the printer further comprises a microswitch for detecting the paper board in a rest configuration.

Preferably, the printer is a dot-matrix printer and is configured for being used in a bank, a post office or the like.

BRIEF DESCRIPTION OF THE DRAWINGS

Embodiments of the present invention will be better understood by reading the following detailed description, to be read by referring to the accompanying drawings, wherein:

FIG. 4.1 is a partial front view, partially cut away, of the printer of FIG. 1 which shows rotation of the paper board;

FIG. 6.1 shows details of the springs which allow the free ends of the paper board to rotate with respect to the roots.

DETAILED DESCRIPTION OF PREFERRED EMBODIMENTS OF THE INVENTION

Figure 1:
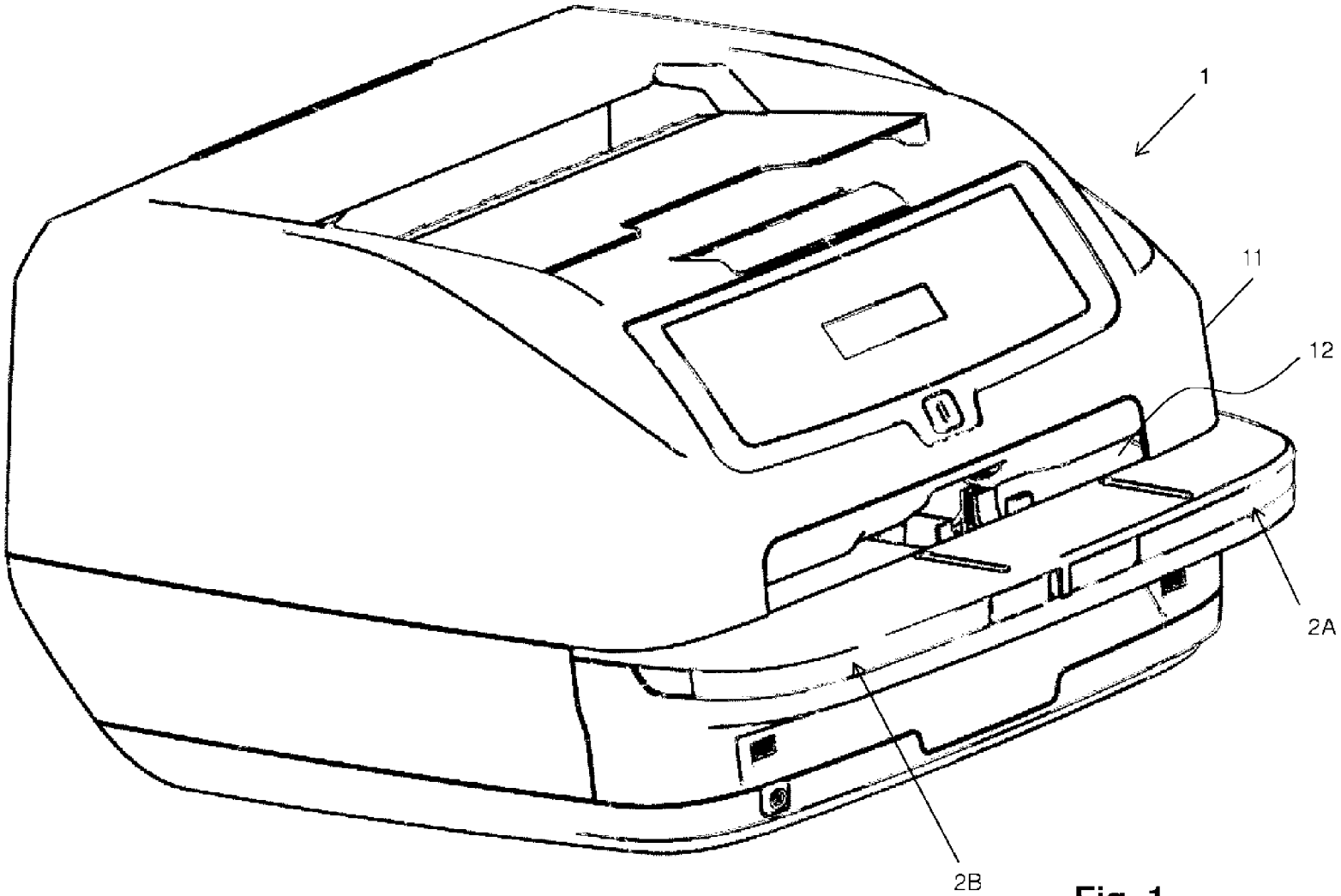
FIG. 1 is a view of a printer according to an embodiment of the present invention.

FIG. 1 schematically shows a printer 1 according to an embodiment of the present invention. The printer 1 comprises a main body 11, possibly made of a plastic material, typically containing mechanical mechanisms (not shown), electric and electronic devices (not shown), printing arrangements and/or reading/detecting devices (not shown) for reading images and/or written matter on a sheet provided to the printer. Mechanical mechanisms comprise any known arrangement for transporting one or more sheets (typically at least partially made of paper) from feeding opening 12 to an output opening or back to the feeding opening 12. Electric and electronic devices comprise any electric device or apparatus for providing power to the printer and for providing the full operation of the printer as it is known in the art. The printer 1 may comprise known printing arrangements for printing images and/or written matter on a sheet provided to the printer. Such printing arrangements may comprise laser printing devices, ink-jet printing devices, dot-matrix printing devices or a combination thereof. The printer 1 may further comprise, possibly in addition to the printing arrangements, known reading/detecting devices for reading images and/or written matter on a sheet provided to the printer. Such reading/detecting devices may comprise optical reading devices, scanners, magnetic reading devices, watermark reading devices or the like.

The above details of the printer 1 will not further described as they are not relevant for the present invention.

The printer 1 which is shown in the Figures may be used in banks, postal offices or the like for printing forms, checks or the like. Preferably, it is based on dot-matrix printing. The printer 1 is intended for single use or for use by a limited number of people and is generally arranged on a desk or the like. It is desirable that the printer takes a small area of the desk.

As it is shown in FIG. 1, the printer 1 comprises a feeding opening 12 for admitting one or more sheets in the printer. Profitably, the sheet(s) is(are) supported by a paper board 2 when the sheet(s) is(are) input into the opening 12 and/or are output therefrom. The paper board 2 maintains the sheet(s) in a substantially horizontal arrangement.

According to one embodiment of the present invention, the paper board 2 comprises two half paper boards 2A and 2B. Preferably, the two half paper boards 2A, 2B are shaped as to comply with the front shape of the printer. This can be inferred from FIGS. 1 and 2.

Figure 2:
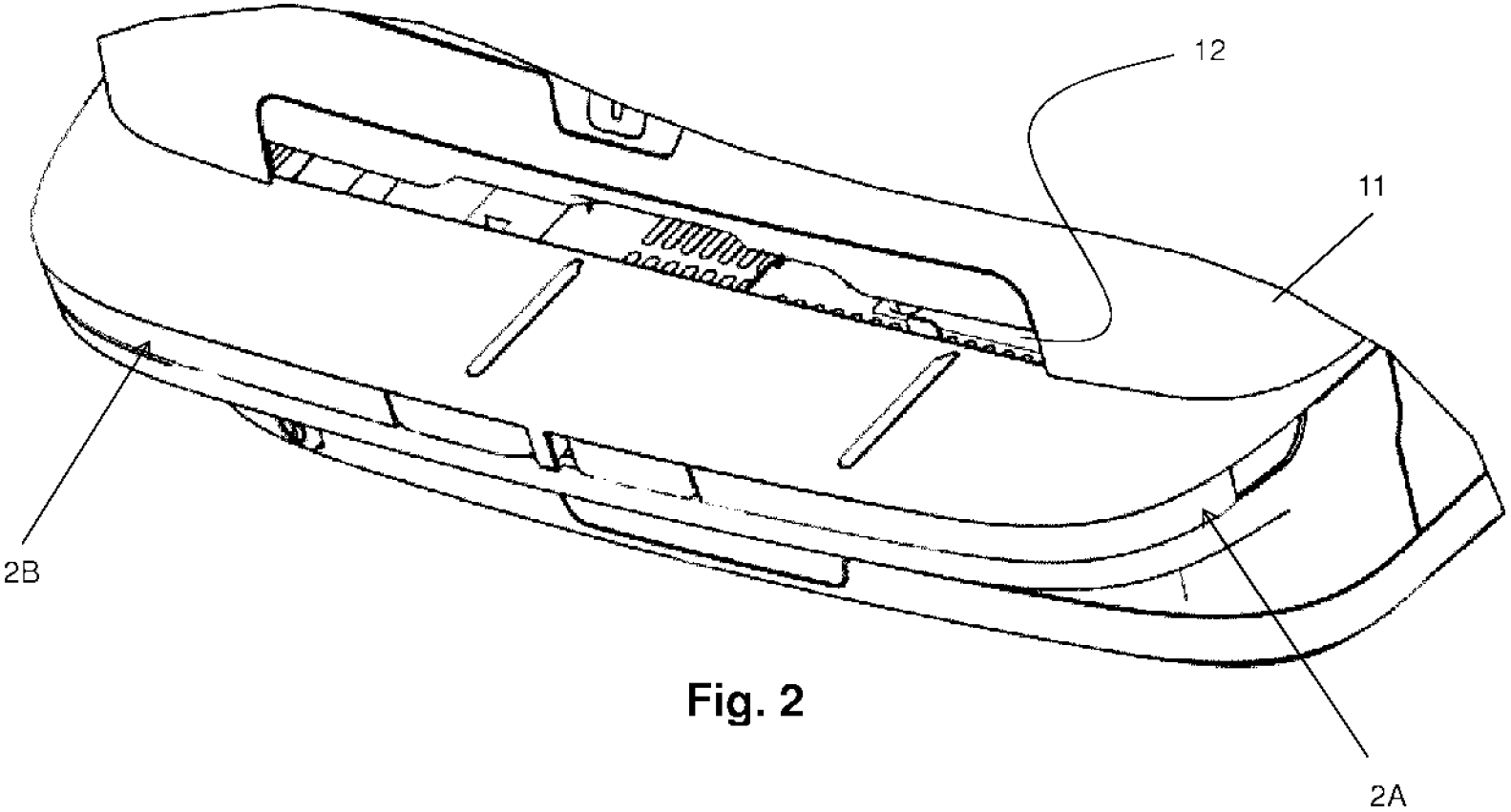
FIG. 2 is a partial front view of the printer of FIG. 1 with paper board retracted.

FIGS. 1 and 2 show the two half paper boards 2A, 2B in the fully retracted state. In this state, the two half paper boards do not substantially project outwardly from the body 11 of the printer 1 and do not provide any support to the sheet(s) to be printed. In this state, profitably, the two half paper boards 2A, 2B are not exposed to (unintentional) damages. Profitably, the two half paper boards 2A, 2B are made of a plastic material. Preferably, the two half paper boards 2A, 2B have a planar top surface, lateral walls which follow the shape of the top surface and a open bottom surface. This is profitable for saving weight, saving plastic material and saving costs.

Figure 5:
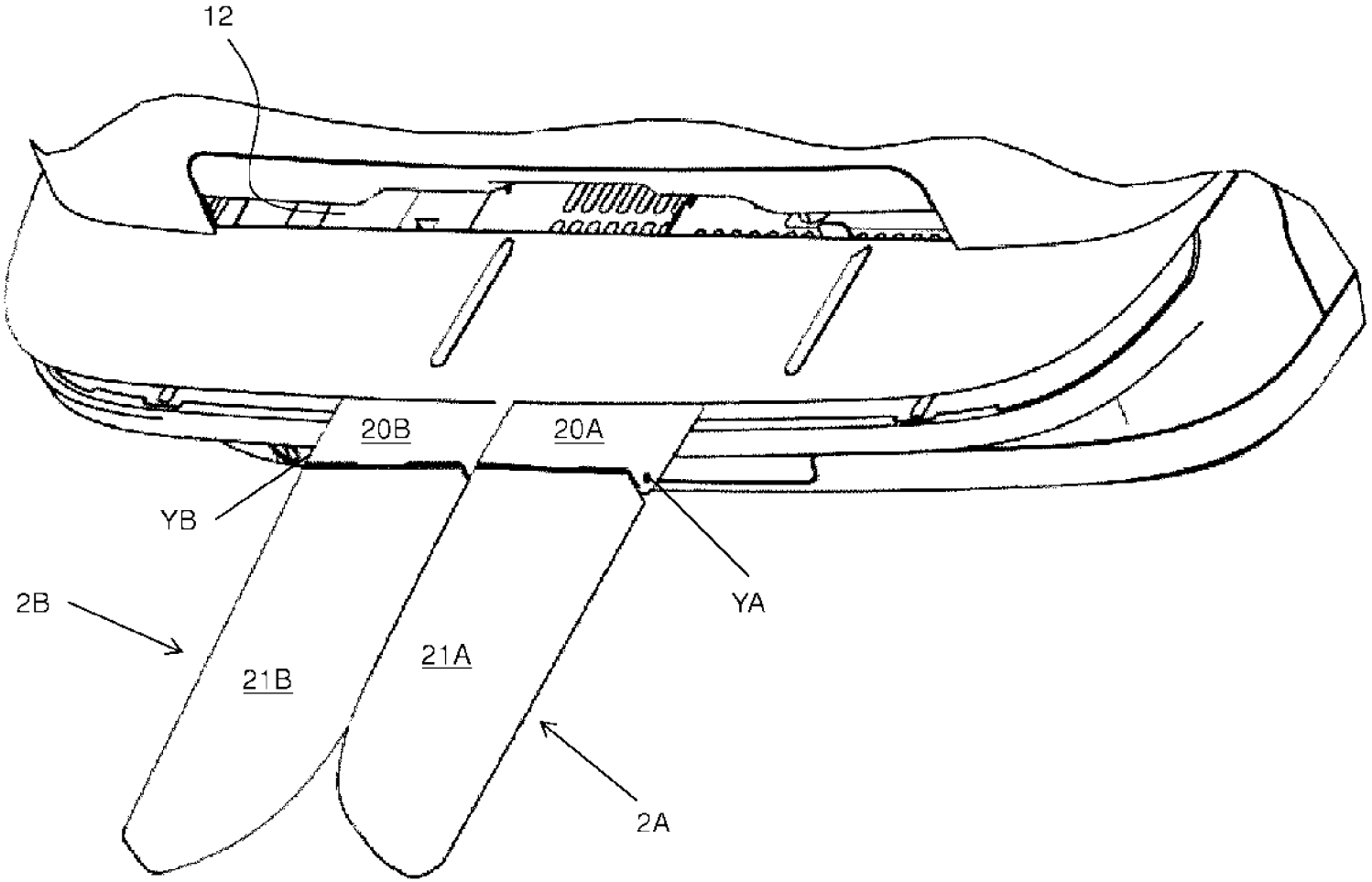
FIG. 5 is a partial front view of the printer of FIG. 1 with paper board fully extracted.

Preferably, the half paper boards 2A, 2B are rotatable from the fully retracted state (FIGS. 1 and 2) to a fully extended state which is shown in FIG. 5. While the fully retracted state correspond to a rest condition, the fully extended state corresponds to a working condition. In the working condition, the two half paper boards 2A, 2B are close to each other and substantially form a single surface. Because of the rounded end 2A1, 2B1 of the half paper boards, a sort of "V" opening is provided at the ends of the half paper boards when they are in the working condition.

Figure 4:
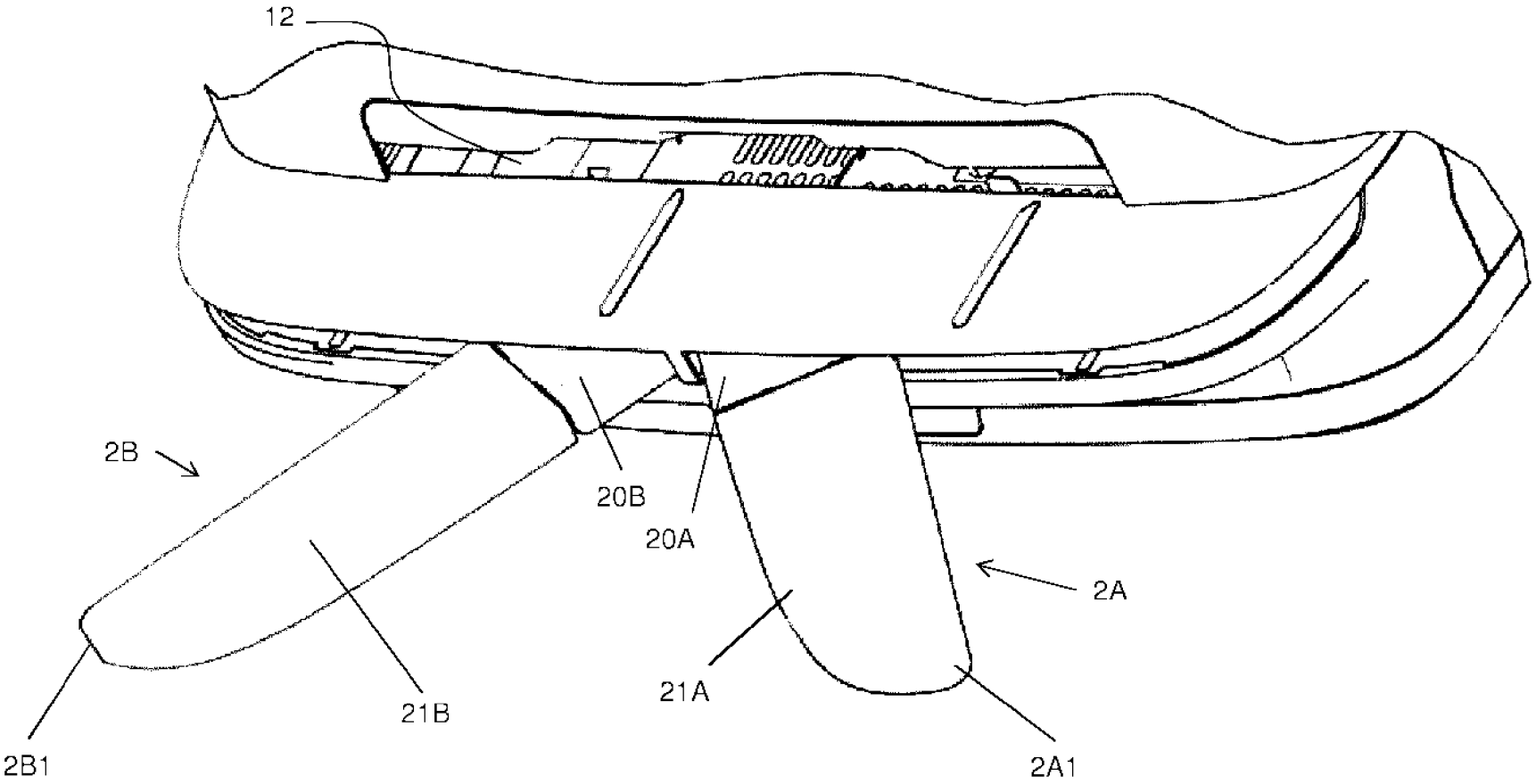
FIG. 4 is a partial front view of the printer of FIG. 1 with paper board partially extracted.

As it is shown, in FIG. 4.1, the two half paper boards 2A, 2B are rotatable about two respective rotation axes XA, XB. Rotation axes XA and XB are, preferably, vertical or substantially vertical when the printer is arranged on a horizontal surface.

The rotation of the two half paper boards 2A, 2B may be coordinated so that rotation of one paper board will cause a corresponding rotation of the other half paper board.

In other embodiments, each half paper board might be independent from the other. Therefore, rotation of one paper board will not cause any corresponding rotation of the other half paper board.

Preferably, the rotation of the half paper boards from the rest position is performed by a user (not shown) who gently hangs the rounded edge of one of (or both) the half paper boards with one finger. The half paper boards 2A, 2B are accompanied by the user up to the fully extended state of FIG. 5.

Passing from the fully extended state (FIG. 5) to the fully retracted state (FIGS. 1 and 2) will be made by the user through a hand rotation movement of one or two half paper boards 2A, 2B.

According to a preferred embodiment of the present invention (see FIG. 3), a magnetic device 3 is provided for maintaining the half paper boards in the fully retracted state. The magnetic device 3 also operates for attracting the half paper boards in the last part of their retraction travel. Thanks to this magnetic device 3, the risk that a portion (even small) of the half paper boards remains projecting and not fully retracted is highly reduced. This also results in an advantage from aesthetic point of view.

The magnetic device 3 may comprise, for each half paper board, a magnet 31 connected to the main body of the printer 1 and a ferromagnetic element 32 connected to half paper board in a proper position corresponding to the magnet.

Figure 3:
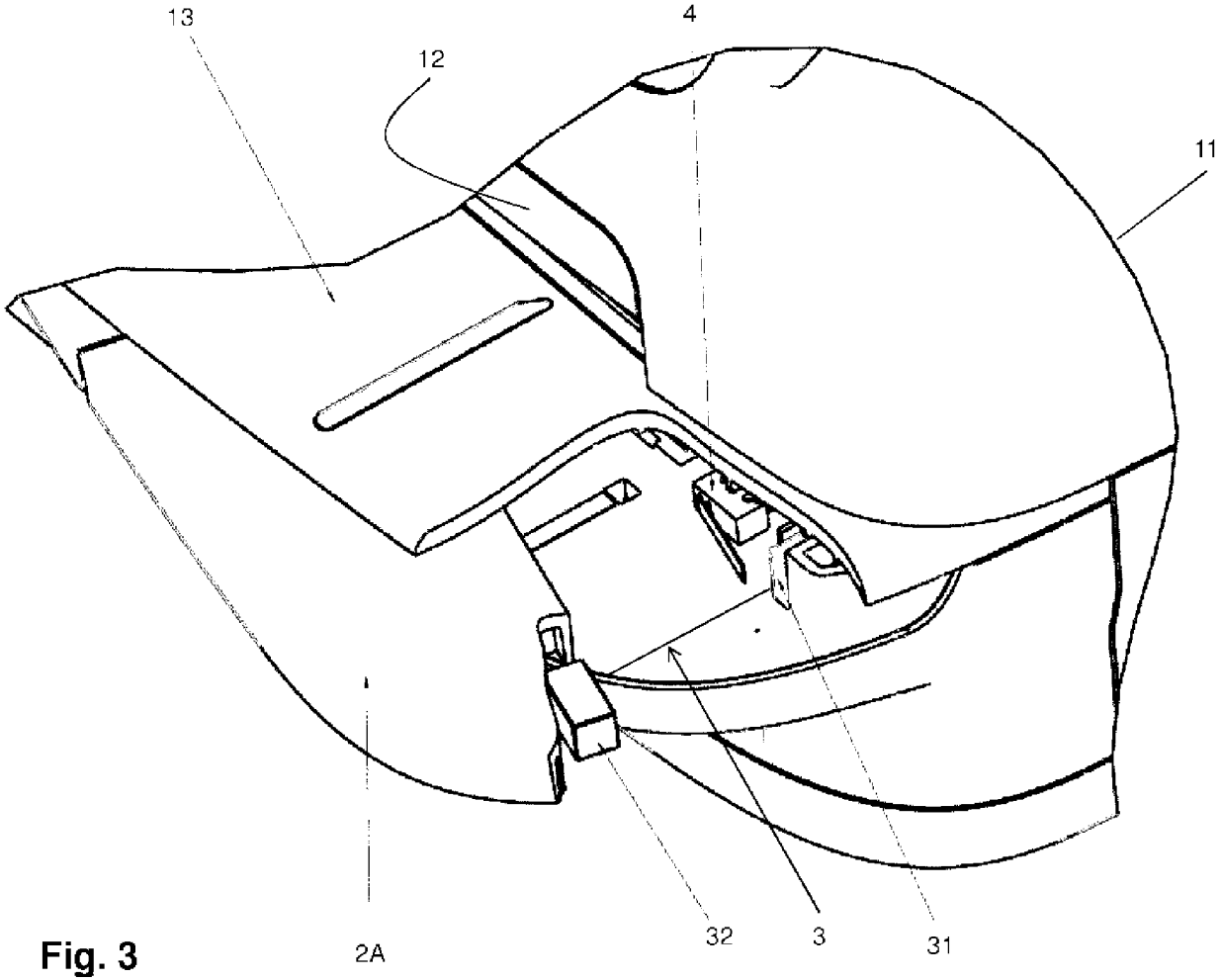
FIG. 3 shows a microswitch and a magnet of a closure magnetic device.

FIG. 3 also shows a microswitch 4 which may be present in embodiments of the present invention. Such a microswitch 4 may detect whether half paper board is in the fully retracted state. FIG. 3 also shows a portion of paper tray 13 of the printer 1.

According to the present invention, each half paper board 2A, 2B comprises a root 20A, 20B and a free end 21A, 21B.

The root 20A, 20B is substantially rigid and can not be deflected (over a tolerance which is standard for similar parts).

On the other hand, the free end 21A, 21B of each half paper board can be deflected (with respect to the root) when a pressure or vertical load is applied thereon.

In one embodiment, the free end 21A, 21B is rotatable with respect to the fixed root 20A, 20B about a rotational axis YA, YB. Rotation of the free end could be mechanically limited to a number of degrees by a stop or the like. In other preferred embodiments, rotation of the free end 21A, 21B could be limited by the contact of the rounded edge 2A1, 2B1 with the surface where the printer is arranged.

Figure 6:
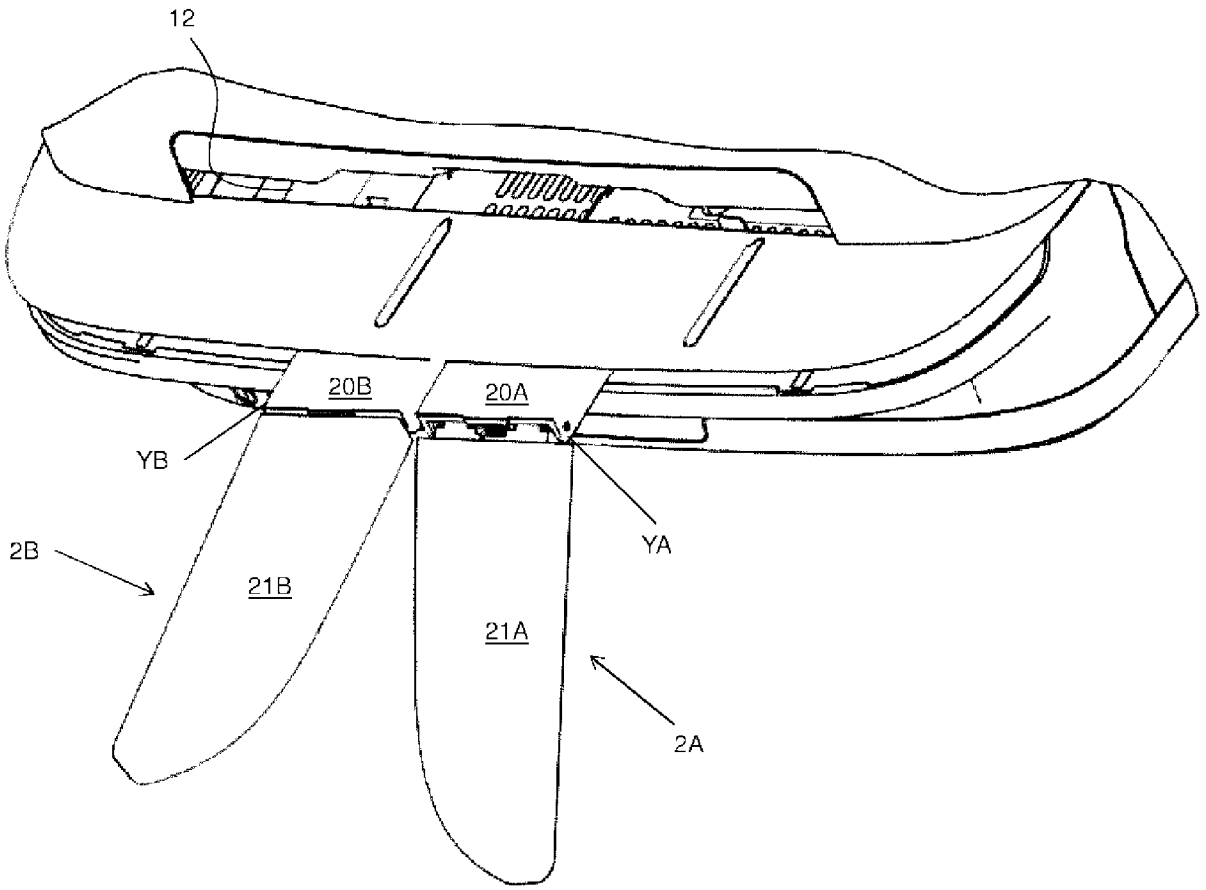
FIG. 6 is a partial front view of the printer of FIG. 1 with paper board fully extracted and subjected to a vertical load.

Preferably, the root 20A, 20B and the free end 21A, 21B are elastically connected together by a resilient means 22A, 22B. Such a resilient means 22A, 22B could be a spring, a rubber element or the like. The arrangement of springs 23A, 23B is shown in FIG. 6.1. The resilient means should have enough force for maintaining the top surface of the free end 21A, 21B substantially at the same level of the top surface of the root 20A, 20B. The resilient means 22A, 22B is also designed for maintaining the free end substantially horizontal also when loaded with a certain load, typically the load corresponding to a single sheet or to a predetermined number of sheets. A safety margin could be provided so that also a higher number of sheets could be sustained without deflection of the free end with respect to the root.

However, when a pressure higher than a predetermined load is applied to one (or both) half paper board, the free end thereof becomes deflected. This deflection avoids breakage of the half paper board as in printers according to the prior art.

Preferably, the root 20A, 20B has a rather short length. Therefore, the connection between root and free end is at a position which is close to the printer main body 11. In this manner, the line of flexibility is close to the main body and the risk of damages to the paper boards 2A, 2B is further reduced.

While having a root and a free end connected through a resilient means, for instance springs 23A, 23B, is deemed to be advantageous and preferable, they might be also connected together through a mechanical arrangement. Such a mechanical arrangement (not shown in the drawings) could be any arrangement which could maintain the free end in a horizontal position when one or a predetermined number of sheets are placed on the paper board. The arrangement should be designed so that when a higher load is placed over the free end, it becomes rotated downwardly. Also this solution prevents damages from a (unintentional) rather high load on the paper board. However, this solution is unable to automatically recover to the working position. In fact, when the free end is rotated downwardly, it should be turned back to the working position and blocked in this position by the user. No automatic recover to the working position is provided as in the embodiments provided with a resilient means.

In some embodiments of the invention, not shown in the drawings, the rotation of the two half paper boards from the fully retracted state to the fully extended state (and possibly back to the fully retracted state) could be made by automatic mechanisms such as motors.

The invention claimed is:

1. A printer comprising:

an opening through which one or more sheets to be treated could be introduced therein;

a paper board for supporting said one or more sheets to be treated, said paper board comprises two half paper boards;

wherein at least one of said half paperboards is rotatable about a vertical axis from a retracted configuration to an extended configuration;

wherein at least one of said half paperboards comprises at least one root and at least one free end; and wherein said at least one free end is rotatable about a horizontal axis with respect to said at least one root when it is subject to a vertical load.

2. The printer of claim 1, wherein said at least one root and said at least one free end are connected through a resilient means.

3. The printer of claim 2, wherein said resilient means comprises a spring.

4. The printer of claim 2, wherein said resilient means comprises a rubber element.

5. The printer of claim 1, wherein said two half paper boards are jointly rotatable so that rotation of one half paper board results in corresponding rotation of the other half paper board.

6. The printer of claim 1, wherein the printer further comprises a magnetic device for attracting at least one of said two half paper boards towards a body of the printer.

7. The printer of claim 6, wherein said magnetic device comprises a magnet and a ferromagnetic element.

8. The printer of claim 1, wherein said printer further comprises a microswitch for detecting at least one of the half paper boards in a rest configuration.

9. The printer of claim 1, wherein said printer is a dot-matrix printer and is configured for being used in a bank, a post office or the like.

10. The printer of claim 1, wherein said two half paper boards are rotated about two parallel vertical axes.

11. The printer of claim 1, wherein said two half paper boards move away from each other when rotated towards the retracted position.

12. A printer comprising:

an opening through which one or more sheets to be treated could be introduced therein;

a paper board for supporting said one or more sheets to be treated, said paper board comprises two half paper boards;

wherein at least one of said half paper boards is rotatable about a vertical axis from a retracted configuration to an extended configuration;

wherein at least one of said half paper boards comprises at least one root and at least one free end;

wherein said at least one free end is rotatable about a horizontal axis with respect to said at least one root when it is subject to a vertical load; and wherein said at least one root and said at least one free end are connected through a resilient means that maintains a top surface of the at least one free end at the same level of a top surface of the at least one root when loaded with a load corresponding to a predetermined number of sheets.

13. The printer of claim 12, wherein said resilient means provides automatic recovery of the top surface of the at least one free end to the same level of the top surface of the at least one root when the at least one free end is moved relative to the at least one root.

* * * * *